US010546738B1

(12) United States Patent
Wang et al.

(10) Patent No.: US 10,546,738 B1
(45) Date of Patent: Jan. 28, 2020

(54) DIELECTRIC COATED ION TRANSFER DEVICE FOR MASS SPECTROMETRY

(71) Applicant: Agilent Technologies, Inc., Santa Clara, CA (US)

(72) Inventors: Mingda Wang, Fremont, CA (US); Maozi Liu, Fremont, CA (US); Patrick D. Perkins, Sunnyvale, CA (US); Jing Tang, San Jose, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 16/226,351

(22) Filed: Dec. 19, 2018

(51) Int. Cl.
*H01J 49/04* (2006.01)
*H01J 49/24* (2006.01)

(52) U.S. Cl.
CPC ..... *H01J 49/0404* (2013.01); *H01J 49/0422* (2013.01); *H01J 49/24* (2013.01)

(58) Field of Classification Search
CPC ..... H01J 49/0404; H01J 49/0422
See application file for complete search history.

(56) References Cited

U.S. PATENT DOCUMENTS

| | | | | |
|---|---|---|---|---|
| 4,542,293 | A | 9/1985 | Fenn et al. | |
| 5,736,740 | A * | 4/1998 | Franzen | H01J 49/0404 250/282 |
| 6,359,275 | B1 | 3/2002 | Bertsch et al. | |
| 6,486,469 | B1 | 11/2002 | Fischer et al. | |
| 7,064,322 | B2 | 6/2006 | Crawford et al. | |
| 7,081,618 | B2 | 7/2006 | Laprade | |
| 7,547,891 | B2 | 6/2009 | Mordehai et al. | |
| 2008/0164409 | A1 * | 7/2008 | Schultz | G01N 27/622 250/282 |
| 2008/0296493 | A1 | 12/2008 | Willoughby et al. | |
| 2018/0166269 | A1 * | 6/2018 | Gu | H01J 49/162 |

* cited by examiner

*Primary Examiner* — Eliza W Osenbaugh-Stewart

(57) ABSTRACT

An ion transfer device includes a tube, a resistive layer on an inside surface of the tube, and a dielectric layer on the resistive layer. The device defines a conduit providing a transfer path for gas and ions. The conduit is surrounded by the dielectric layer. The dielectric layer protects the resistive layer from the chemical environment in the conduit, while being thin enough to allow charges to pass through the dielectric layer and be dissipated by the resistive layer.

20 Claims, 4 Drawing Sheets

DIELECTRIC COATED ION TRANSFER DEVICE FOR MASS SPECTROMETRY

TECHNICAL FIELD

The present invention relates generally to an ion transfer device, such as may be utilized to transfer ions from an atmospheric-pressure ion source into a mass spectrometer.

BACKGROUND

In the process of analyzing a sample by mass spectrometry (MS), an MS system first ionizes the sample to create analyte ions. The MS system then transfers the ions into a mass analyzer, and the mass analyzer resolves the ions on the basis of the ions' differing mass-to-charge (m/z) ratios. An ion detector measures the abundance of the ions at each m/z ratio detected. The MS system then processes signals outputted by the ion detector to generate mass (m/z) spectra that provide quantitative and qualitative information regarding the components of the sample (e.g., compounds, isomers, elements, etc.).

The mass analyzer operates in a controlled high-vacuum environment, for example at $10^{-5}$ to $10^{-9}$ Torr. In some MS systems, the ion source (where ionization of the sample is performed) also operates at a vacuum pressure. In other MS systems, such as when coupled to a liquid chromatography (LC) instrument (an LC-MS system), the ion source operates at or around atmospheric pressure. An MS system utilizing an atmospheric pressure ionization (API) source requires an interface between the API source and the evacuated regions of the MS system in which the mass analyzer and other devices are located. The interface needs to effectively isolate the atmospheric-pressure region where the ions are created (the API source) from the evacuated regions where the ions are processed and measured. At the same time, the interface needs to provide a way to efficiently transport the ions from the API source into the evacuated regions after the ions are created.

An ion transfer device in the form of a capillary (i.e., small-bore) tube is often utilized to transfer the ions from the API source into the first vacuum region of the MS system. The capillary tube has a small inside bore, the diameter of which may range from a fraction of a millimeter (mm) to a few millimeters. The capillary tube extends through the boundary between the API source and the first vacuum region, whereby the capillary tube's entrance is exposed to the ionization region of the API source and the capillary tube's exit is exposed to the first vacuum region. Ions and gas in the API source are drawn into the capillary tube's entrance, transported through the capillary tube's bore, and emitted from the capillary tube's exit into the first vacuum region. Ion optics guide the ions further into the MS system and ultimately to the mass analyzer.

The capillary tube may be metal, which allows for fast polarity switching in applications where the MS system is switched between detecting positive ions and negative ions. However, the metal inside wall defining the inside bore, or lumen, of the capillary tube is easily oxidized or subjected to other types of chemical reaction (e.g., deposition and/or erosion) that degrade the performance of the capillary tube and shorten its usable service life.

Alternatively, the capillary tube may be composed of a pure dielectric material (i.e., a bulk dielectric material) such as glass. However, electrostatic surface charges in the bore tend to build up on the dielectric inside wall, and the dielectric material is unable to carry away the charges. This results in reduced ion transmission efficiency and thus loss of ion signal, especially in the case of lower ion masses for which the ion signal may eventually completely vanish. Moreover, this type of dielectric capillary tube is incapable of fast polarity switching.

A dielectric capillary tube may be provided with metal coatings as electrodes at its inlet end and outlet end to allow the application of voltage potential gradient. However, such end-coated capillary tube suffers the same problems in the middle part between the coated ends. Additionally, the metal coatings are subjected to the harsh chemical environment and thus are prone to degradation as noted above.

As another alternative, the capillary tube may be constructed of a dielectric material with an electrically resistive coating on the inside surface of the capillary bore. That is, the coating is a material that is electrically conductive with a high electrical resistance. This approach reduces the problem of the dielectric wall becoming charged, as the resistive material is able to dissipate the charges. The approach may improve ion transport as much as 100-fold in comparison to use of a purely dielectric capillary, and also may enable faster polarity switching. However, the resistive coatings are usually metallic and thus easily degraded by oxidization or other chemical reaction, thereby degrading the performance of the capillary tube. For example, such reactions may change the conductivity of the resistive coating and degrade ion transmission efficiency.

Because a capillary tube becomes degraded due to exposure to the harsh chemical environment, users of MS systems are forced to clean or replace the capillary tube frequently to maintain a consistent ion signal response and stability in the MS system. Each cleaning or replacement of the capillary tube requires shutting down the MS system, cooling down the capillary tube, and in many cases bringing the MS system down to ambient pressure. The cleaning or replacement of the capillary tube may require the MS system to be out of operation for several days, severely limiting productivity.

In view of the foregoing, a need remains for improved ion transfer devices such as capillary tubes.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, an ion transfer device includes: a tube comprising an inlet end, an outlet end, a body elongated along a device axis from the inlet end to the outlet end, and an inside surface defining a bore, wherein the bore comprises a bore inlet at the inlet end and a bore outlet at the outlet end, and the bore extends from the bore inlet to the bore outlet along the device axis; a resistive layer disposed on the inside surface and composed of an electrically resistive material; and a dielectric layer disposed on the resistive layer and composed of a dielectric material, wherein the ion transfer device defines a gas conduit in the bore extending from the bore inlet to the bore outlet, and the gas conduit is surrounded by the dielectric layer.

According to another embodiment, an ion transfer system includes: an ion transfer device according to any of the embodiments disclosed herein; a first chamber; a second chamber configured to be evacuated down to a pressure lower than a pressure of the first chamber; and a wall separating the first chamber and the second chamber and comprising an opening, wherein the ion transfer device extends through the opening such that the bore inlet communicates with the first chamber and the bore outlet communicates with the second chamber.

According to another embodiment, a mass spectrometry (MS) system includes: an ion transfer system according to any of the embodiments disclosed herein; an ionization device configured to produce ions in the first chamber; a vacuum housing enclosing the second chamber; and a mass analyzer disposed in the vacuum housing.

According to another embodiment, an ion mobility spectrometry (IMS) system includes: an ion transfer device according to any of the embodiments disclosed herein; an ion source; an IM drift cell communicating with the ion source; and an ion detector; wherein the ion transfer device is positioned in the IM drift cell such that the bore inlet is configured to receive ions from the ion source, and the ion detector is configured to receive ions emitted from the bore outlet.

According to another embodiment, a method for transferring ions includes: drawing ions into the bore inlet of an ion transfer device according to any of the embodiments disclosed herein; transporting the ions from the bore inlet, through the gas conduit, and to the bore outlet; and emitting the ions from the bore outlet.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

As used herein, the term "atmospheric pressure" is not limited to exactly 760 Torr, or one atmosphere (1 atm), but instead generally encompasses a range around 760 Torr (e.g., 100 to 900 Torr).

As used herein, the term "vacuum" or "vacuum pressure" generally refers to a pressure that is at least an order of magnitude less than atmospheric pressure. For example, vacuum pressure may encompass sub-atmospheric pressures down to $10^{-9}$ Torr or lower.

As appreciated by persons skilled in the art, different types of vacuum pumps may be utilized to bring an enclosed space, or vacuum chamber, down to different ranges of low pressure. For example, a "roughing" pump (or "backing" pump) may be utilized to pump a vacuum chamber down to a "rough" vacuum level of, for example, down to about $10^{-3}$ Torr. Roughing pumps typically have a predominantly mechanical design, examples of which include, but are not limited to, scroll pumps, rotary vane pumps, diaphragm pumps, Roots blower (positive displacement lobe) pumps, etc. High-vacuum pumps are utilized to achieve higher levels of vacuum (lower pressures), for example down to $10^{-9}$ Torr or lower. Examples of high-vacuum pumps include, but are not limited to, diffusion pumps, turbomolecular pumps and sputter-ion pumps. A roughing pump may be utilized in conjunction with a high-vacuum pump as a first stage of vacuum pump-down and/or to isolate a high-vacuum pump from rough-vacuum or higher-pressure environments.

Figure 1:
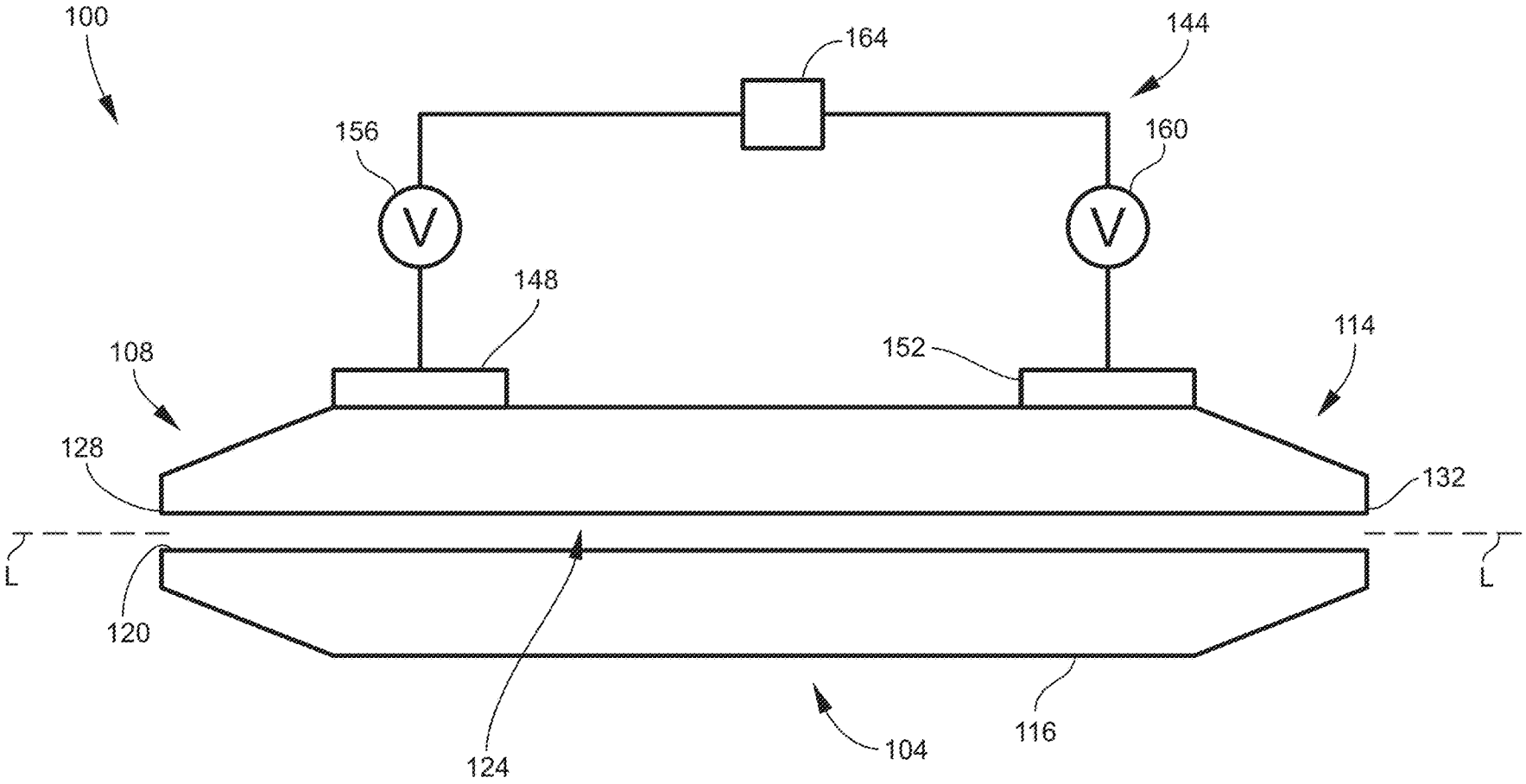
FIG. 1 is a schematic cross-sectional side (lengthwise) view of an ion transfer device according to an embodiment of the present disclosure.
Figure 2:
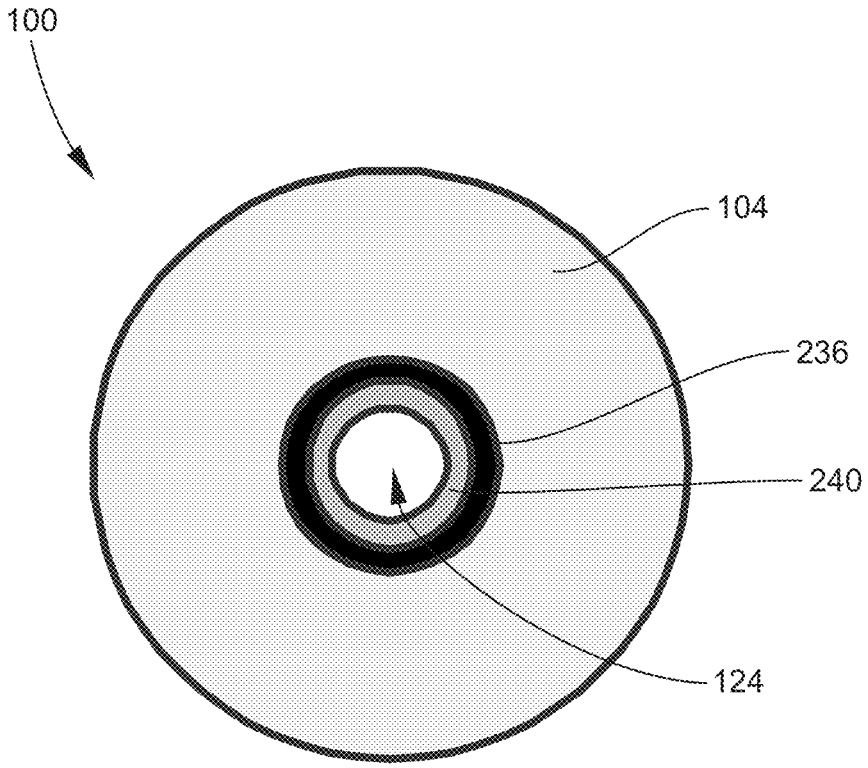
FIG. 2 is a schematic cross-sectional transverse view of the ion transfer device illustrated in FIG. 1, in which the cross-section is taken through a transverse plane orthogonal to the device axis.

FIG. 1 is a schematic cross-sectional side (lengthwise) view of an ion transfer device 100 according to an embodiment of the present disclosure. Generally, the ion transfer device 100 has a length along a longitudinal, or device, axis L. FIG. 2 is a schematic cross-sectional transverse view of the ion transfer device 100 illustrated in FIG. 1, in which the cross-section is taken through a transverse plane orthogonal to the device axis L, i.e. into the drawing sheet of FIG. 1.

The ion transfer device 100 includes a tube 104. The tube 104 includes an inlet end 108, an outlet end 114, and a body 116 elongated along the device axis L from the inlet end 108 to the outlet end 114. The body 116 has an inside surface or wall 120 defining a tube bore 124. The bore 124 includes a bore inlet 128 and a bore outlet 132, and extends from the bore inlet 128 to the bore outlet 132 along the device axis L. The bore 124 provides a path or conduit for ions and gas to flow from the inlet end 108 to the outlet end 114. One or both axial ends of the tube 104 may be tapered, as illustrated in FIG. 1.

In an embodiment (and as illustrated), the inside diameter of the bore 124 is constant along the length of the body 116, such that the inside diameter of the bore inlet 128 is the same as the inside diameter of the bore outlet 132. In other embodiments, the inside diameter of the bore 124 may vary, i.e., may be increased or reduced along the entire length of the body 116 (or in one or more axial sections of the body 116) in a gradual or step-wise manner in the direction of ion travel (i.e., toward the outlet end 114). Varying the inside diameter of the bore 124 may be done to achieve a desired effect on the mechanics of the ion flow and/or fluid flow into, through, or from the bore 124.

Generally, the tube 104 may be composed of any material suitable for use in transferring ions and gas in an associated instrument, such as in an interface between an ion source and a lower pressure region of a mass spectrometer, or in an ion mobility drift cell. Thus, for example, the tube 104 may be composed of an electrically conductive material (e.g., a metal, metal alloy, conductive plastic, etc.), an electrically insulating material (e.g., a glass, fused silica, metal oxide, other type of ceramic, metal nitride, insulating or dielectric polymer, etc.), an electrically insulating (or dielectric) material with bulk electrical resistance, or an electrically insulating (or dielectric) material with surface electrical resistance.

In one non-exclusive example, the tube 104 has a length (from inlet end 108 to outlet end 114) in a range of 40 cm to 300 cm, and an outside diameter in a range of 3 mm to 12 mm. In one non-exclusive example, the gas conduit defined by the bore 124 has an inside diameter in a range from 0.1 mm to 2 mm. In such examples, the tube 104 may be characterized as being a capillary or having a capillary inner bore.

As shown in FIG. 2, the ion transfer device 100 further includes a resistive layer 236 (e.g., a film, coating, lining, etc.) disposed on the inside surface 120. The resistive layer 236 may be composed of any electrically resistive material (i.e., a material that is conductive but is highly resistive) suitable for providing the ion transfer device 100 with a uniform electrical resistance along its length. In one example, the resistive layer 236 may be composed of hydrogen-reduced lead-enriched glass, such as in the form of continuous thin layer or nanoclusters or nanoparticle aggregates. Examples of hydrogen-reduced lead-enriched glass are described in U.S. Pat. Nos. 7,081,618 and 7,547,891, the entire contents of which are incorporated herein by reference. In other examples, the resistive layer 236 may be composed of carbon, cermet, a metal, a conductive polymer, or a semiconductor. In an embodiment, the resistive layer 236 may have a thickness (i.e., defined in a radial direction orthogonal to the device axis L) in a range from 10 nm to 300 nm. In an embodiment, the resistive layer 236 may extend along the entire length of the bore 124 from the bore inlet 128 to the bore outlet 132.

The resistive layer 236 is useful for improving ion transmission efficiency and enabling fast polarity switching. However, the harsh chemical and high-temperature environment to which a resistive layer is exposed in conventional resistive capillary devices degrades the performance characteristics of the resistive layer and hence decreases the service life of the capillary device.

To address this problem, the presently disclosed ion transfer device 100 further includes a dielectric layer 240 (e.g., a film, coating, lining, etc.) disposed on the resistive layer 236, as shown in FIG. 2. The dielectric layer 240 is composed of a dielectric material that is chemically inert. That is, the dielectric material is one that is unreactive with chemical species (compounds or elements) that flow through the bore 124 in the use of the ion transfer device 100. Examples of chemical species that may cause undesired or harsh reactions with the resistive layer 236 include, but are not limited to, oxygen, hydrogen fluoride, and sodium hydroxide.

Generally, different dielectric materials may be chosen for the dielectric layer 240, depending on the chemical environment the ion transfer device 100 is expected to encounter. In some embodiments, the dielectric layer 240 is composed of a chemically inert metal oxide, a few non-limiting examples being silicon dioxide, zirconium dioxide, and hafnium dioxide.

In an embodiment, the dielectric layer 240 is a thin layer, unlike the bulk dielectric material employed in conventional resistive capillary devices. In particular, the dielectric layer 240 is thin enough to allow surface charges to pass (migrate or leak) through the dielectric layer 240 due to a charge tunneling effect, and subsequently be dissipated by the underlying resistive layer 236. For example, the dielectric layer 240 may have a thickness t (i.e., defined in a radial direction orthogonal to the device axis L) in a range from 0.005 μm to 300 μm.

Because it is chemically inert, the dielectric layer 240 serves to protect the underlying resistive layer 236 against undesired or harsh reactions in which the ion transfer device 100 may operate, thereby increasing the service life of the ion transfer device 100. Moreover, because it is thin, the dielectric layer 240 will not impair the performance characteristics of the resistive layer 236. For example, the thin dielectric layer 240 will not impede the ability of the resistive layer 236 to dissipate surface charges and implement fast polarity switching.

Depending on its length, the dielectric layer 240 may partially or fully surround the gas conduit defined by the bore 124, and thus may define the actual inside diameter of the gas conduit. In an embodiment, the dielectric layer 240 covers the entire length of the resistive layer 236 to provide maximum protection. Accordingly, if the resistive layer 236 extends along the entire length of the bore 124 from the bore inlet 128 to the bore outlet 132, the dielectric layer 240 may likewise do the same.

The resistive layer 236 and the dielectric layer 240 may be fabricated or formed in the bore 124 by any suitable technique appropriate for the materials utilized. For example, one or more types of vacuum deposition may be employed. As another example, the resistive layer 236 may be formed, for example, by applying (e.g., painting) a resistive ink such as a carbon ink, cermet ink, metallic ink, conductive plastic ink, or polymer ink, as further described in U.S. Pat. No. 7,064,322, the entire contents of which are incorporated by reference herein.

As further shown in FIG. 1, the ion transfer device 100 may further include an electrical power source 144 communicating with the tube 104 or the resistive layer 236 at or near the inlet end 108 and/or the outlet end 114. For example, the power source 144 may be coupled directly to the tube 104 or the resistive layer 236, or may be coupled to electrodes, such as a first electrode 148 positioned at or near the inlet end 108 and/or a second electrode 152 positioned at or near the outlet end 114. The first electrode 148 and second electrode 152 may be positioned on the outer surface of the tube 104 (or body 116), and may partially or fully surround (e.g., as rings or bands, or coatings) the tube 104. The first electrode 148 and second electrode 152 may be electrically conductive or resistive elements.

Separate electrode elements or coatings such as the first electrode 148 and second electrode 152 may be independently addressable by respective voltage sources, thereby enabling the generation of a potential difference of desired magnitude across a desired axial section or sections of the tube 104. Alternatively, the tube 104 may be an insulating material having a bulk resistance that enables generation of an electric field in response to application of voltages. In an embodiment, the tube 104 may be fabricated in segments, with the tube segments being independently addressable by respective voltage sources to enable the application of a highly controlled axial voltage gradient if desired.

The power source 144 may be configured to apply a voltage potential to the tube 104 or the resistive layer 236 at or near the inlet end 108, or additionally at or near the outlet end 114. The power source 144 may be configured to generate an axial electrical potential gradient field through the bore 124 from the bore inlet 128 to the bore outlet 132. The gradient may be uphill (in which the absolute magnitude of the voltage potential at the outlet end 114 is higher than at the inlet end 108) or downhill (in which the absolute magnitude of the voltage potential at the outlet end 114 is lower than at the inlet end 108). In addition, a voltage potential applied at or near the inlet end 108 may be utilized to attract ions to the bore inlet 128. The power source 144 may be configured to rapidly switch the polarity of the applied voltage potentials or gradient field as needed to switch between transport of positive ions and negative ions through the gas conduit of the bore 124. For all such purposes, the power source 144 is schematically depicted as including a first voltage source 156 or additionally a second voltage source 160, and an electronic controller 164 (i.e., including appropriate electronic circuitry) for controlling the application and adjustment of the voltage potential(s).

The ion transfer device 100 may further include a heating device (not shown) to maintain the tube 104 at an elevated temperature. This may be done, for example, to promote evaporation and desolvation of droplets in the gas conduit of the bore 124, thereby liberating more ions and facilitating the removal of neutral molecules not of interest to the analysis.

Figure 3:
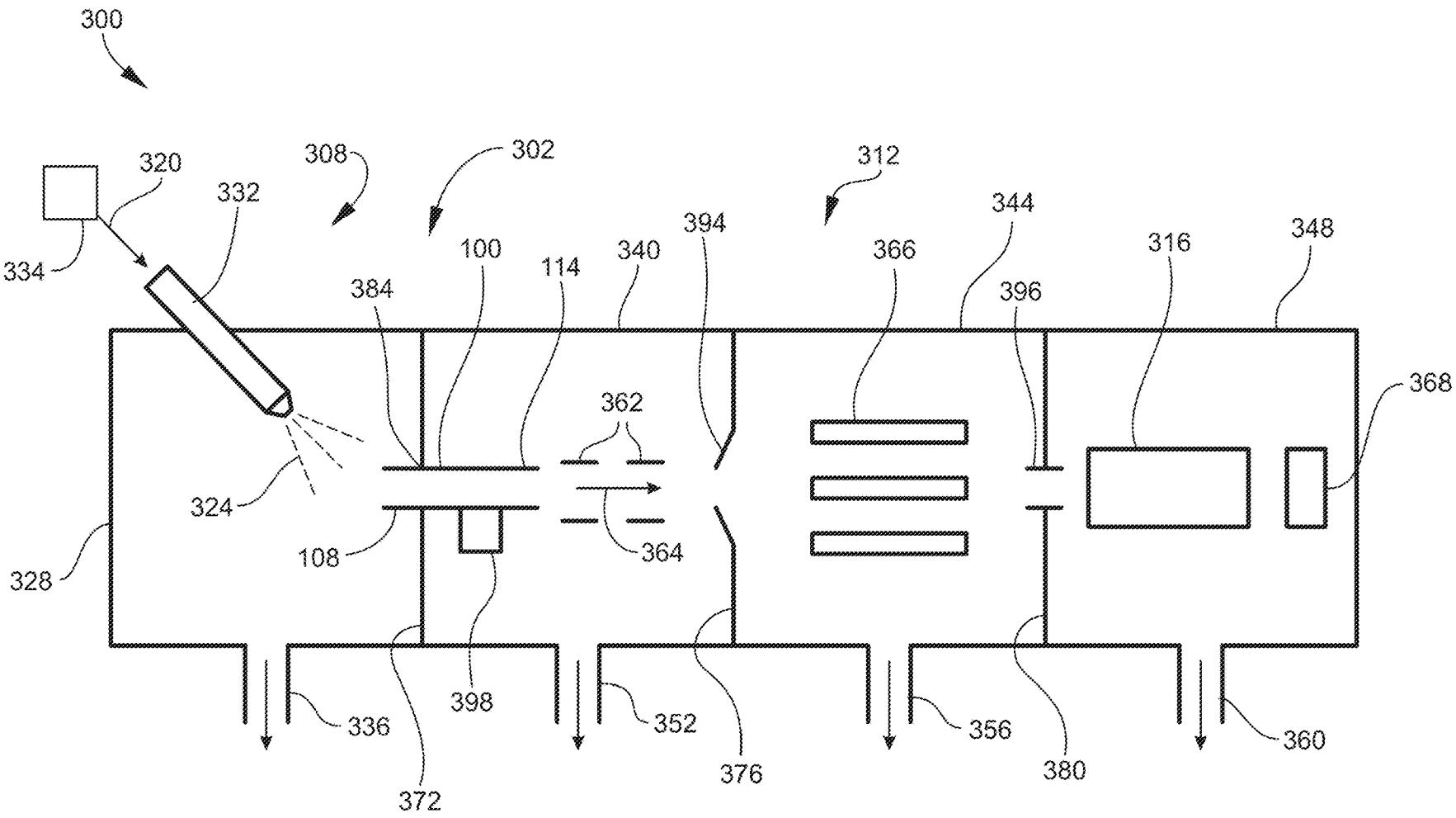
FIG. 3 is a schematic view of an example of a mass spectrometry (MS) system in which an ion transfer device as presently disclosed herein may be provided according to an embodiment.

FIG. 3 is a schematic view of an example of a mass spectrometry (MS) system 300 in which an ion transfer device 100 as presently disclosed herein may be provided according to an embodiment. An MS system is but one non-exclusive example of an operating environment for the ion transfer device 100. More generally, the ion transfer device 100 may be utilized in any system in which ions are transferred from one region to another region. In the case of an MS system, the ion transfer device 100 may transfer ions from a region held at a relatively high pressure (e.g., atmospheric pressure) to another region held at a relatively lower pressure (e.g., sub-atmospheric or vacuum pressure). Different types of MS systems, their operating principles, and their components are generally known to persons skilled in the art. Therefore, the example of the MS system 300 illustrated in FIG. 3 is described herein only briefly to provide a non-limiting context for the presently disclosed ion transfer device 100.

In the illustrated example, the MS system 300 includes an atmospheric-pressure ionization (API) source (or ion source) 308 interfaced with a vacuum housing 312 in which a mass analyzer 316 and other ion processing components are located. Accordingly, the API source 308 is configured to ionize a sample 320 generally at atmospheric pressure, whereas the mass analyzer 316 is required to operate at high vacuum (very low pressure) in the usual manner. The ion transfer device 100 provides an ion transfer path for ions (and neutral gas molecules or atoms) 324 to pass from the API source 308 into the vacuum housing 312.

The API source 308 includes a first chamber 328, which in the present embodiment is an ionization chamber in which ions 324 are produced from the sample 320. The API source 308 also includes an atmospheric-pressure (AP) ionization device 332, which may be any device capable of ionizing a sample 320 at atmospheric pressure. Examples of AP ionization devices include, but are not limited to, spray-type devices (electrospray ionization (ESI) devices, thermospray ionization devices, sonic spray ionization devices, etc.), atmospheric-pressure chemical ionization (APCI) devices, atmospheric-pressure photoionization (APPI) devices, atmospheric-pressure laser desorption ionization (AP-LDI) devices, atmospheric-pressure matrix-assisted laser desorption ionization (AP-MALDI) devices, other ambient-pressure ionization devices (e.g., desorption electrospray ionization or DESI devices, direct analysis in real time or DART ionization devices, etc.), etc. Thus, depending on the embodiment, the ions 324 schematically depicted in FIG. 3 may be representative of an effluent from the ionization device 332 that includes, in addition to the ions 324, droplets containing analytes and non-analytical sample matrix materials that may be evaporated to produce more ions, and gas molecules or atoms utilized to nebulize the sample 320 and/or carry the sample 320 to the ionization device 332.

Depending on the type of ionization device 332 utilized, the sample 320 may be initially provided in the form of a fluid or a solid. For example, the sample 320 may be flowed to or into the ionization device 332 from a sample source 334. In some embodiments, the sample source 334 may be the output of a liquid chromatography (LC) instrument, capillary electrophoretic-based chromatography instrument, or other type of analytical separation instrument, as appreciated by persons skilled in the art. As another example, the sample 320 may be provided on a solid target surface (another type of sample source 334) and desorbed from the surface by the ionization device 332 (e.g., by using a flow of electrospray or a laser beam). The API source 308 may further include an exhaust port 336 through which gases and vapors may be removed from the first chamber 328 during the ionization process.

The vacuum housing 312 includes one or more vacuum chambers as necessary for pumping the MS system 300 down to the very low pressure (high vacuum) required for operating the mass analyzer 316, and for containing intermediate devices utilized for performing operations on the ions 324 prior to final mass analysis by the mass analyzer 316. In the illustrated example, the vacuum housing 312 includes a second vacuum chamber 340, a third vacuum chamber 344, and a fourth vacuum chamber 348, with the understanding that less or more vacuum chambers may be provided depending on the embodiment. The vacuum chambers 340, 344, and 348 include respective vacuum ports 352, 356, and 360 communicating with a vacuum system (schematically represented by downward arrows), which is configured for maintaining a specific level of vacuum in each of the vacuum chambers 340, 344, and 348 by removing gases at respective, controlled flow rates. Typically, the vacuum chambers 340, 344, and 348 are held (maintained by the vacuum system) at successively lower pressures, with the final (third) vacuum chamber 344 enclosing the mass analyzer 316 being held at the lowest pressure (highest vacuum) obtained by the MS system 300.

In the illustrated example, ion optics 362 are disposed in the second vacuum chamber (or interface chamber) 340, or alternatively may be disposed in a chamber (not shown) separate from the second vacuum chamber 340. Generally, the ion optics 362 may be one or more ion optics components (e.g., ion lenses) configured to focus ions exiting the ion transfer device 100 as a beam of ions 364 for further efficient transport into the evacuated regions of the MS system 300. For this purpose, (typically electrostatic) electrical potential(s) may be applied to the ion optics 362, as appreciated by persons skilled in the art. Also in the illustrated example, an ion guide 366 is disposed in the third chamber 344. The ion guide 366 may be of any type such as, for example, a linear multipole ion guide, an ion funnel, a collision cell, a mass filter, etc., or a combination of two or more such devices, as appreciated by persons skilled in the art. FIG. 3 illustrates a linear multipole ion guide by example, which includes a set of rod electrodes elongated along (and typically, but not always, parallel with) the central ion optical axis. Typically, the linear multipole ion guide has a quadrupole configuration (four rod electrodes), a hexapole configuration (six rod electrodes), or an octopole configuration (eight rod electrodes). For simplicity, only three rod electrodes are shown in FIG. 3.

The mass analyzer 316 and an ion detector 368 are disposed in the fourth chamber 348. The mass analyzer 316 may be of any type such as, for example, a quadrupole mass analyzer, a time-of-flight (TOF) analyzer, an ion cyclotron resonance (ICR) cell, a magnetic sector instrument and/or an electric sector instrument, an electrostatic ion trap, etc. The ion detector 368 may be of any type such as, for example, an electron multiplier, a multi-channel detector, a photomultiplier, a Faraday cup, etc.

Many other types of ion optics may be included in the chambers 328, 340, 344, and 348, as needed for the intended use and operation of the MS system 300, as appreciated by persons skilled in the art.

Adjacent chambers 328, 340, 344, and 348 of the MS system 300 may be separated by respective partitions or walls 372, 376, and 380. The ion transfer device 100 may extend into or through an opening 384 formed through the thickness of the wall 372 that separates the first (ionization) chamber 328 and the second (interface) chamber 340. By this configuration, the inlet end 108 of the ion transfer device 100 communicates with the first chamber 328, and the outlet end 114 of the ion transfer device 100 communicates with the second chamber 340. Thus, the inlet end 108 faces and may be disposed in the first chamber 328, and the outlet end 114 faces and may be disposed in the second chamber 340. In addition to providing an ion transfer path, the ion transfer device 100 is configured to serve as a gas conductance barrier that limits the flow of gas through the ion transfer device 100 and effectively maintains a pressure differential between the atmospheric-pressure first chamber 328 and the sub-atmospheric-pressure second chamber 340. The ion transfer device 100 may be mounted to the wall 372 in a fluid-tight manner, whereby the interior passage of the ion transfer device 100 provides the sole path for ions to travel from the API source 308 into the vacuum housing 312, and conductance of gas through the annular interface between the outside surface of the ion transfer device 100 and the inside surface of the wall 372 defining the opening 384 is prevented or at least significantly limited. Other walls (e.g., walls 376 and 380) separating adjacent chambers include openings (e.g., openings 394 and 396) that may function as gas conductance barriers, sampling or skimmer cones, ion optics, etc.

In operation, ions and gas 324 flow through the ion transfer device 100 under the influence of the pressure differential between the first chamber 328 and the second chamber 340. As described herein, the ion transfer device 100 may include one or more electrodes (e.g., electrically conductive or electrically resistive elements), such as for example at its inlet end 108 and/or outlet end 114, communicating with electrical circuitry (e.g., one or more voltage sources and/or electrical grounds). A voltage imparted between these electrodes generates an electric field across the axial length of the ion transfer device 100 that may assist in urging the ions through the ion transfer device 100.

As also described herein, the ion transfer device 100 may include a heating device 398 to promote evaporation of droplets and desolvation of ions while the ions and droplets travel through the ion transfer device 100. Generally, the heating device 398 may be any device suitable for transferring heat to fluids flowing through the interior of the ion transfer device 100 by heat conduction or a combination of heat conduction and convection. The heating device 398 may or may not directly contact the ion transfer device 100. Heating devices suitable for use in ion source-mass spectrometer interfaces are generally known to persons skilled in the art.

According to an embodiment, an ion transfer device as described herein may be provided as part of an ion transfer system. For example, FIG. 3 illustrates an ion transfer system 302. The ion transfer system 302 may include a first chamber 328, a second chamber 340, a wall 372 separating the first chamber 328 and the second chamber 340, and an ion transfer device 100 configured according to any of the embodiments described herein. The second chamber 340 is configured to be evacuated down to a pressure lower than a pressure of the first chamber 328. The wall 372 has a wall thickness in the axial direction (i.e., in the direction of ion and gas flow through the ion transfer device 100), and includes a wall opening 384 extending through the wall thickness. The ion transfer device 100 is positioned at the wall 372 such that at least part of the ion transfer device 100 extends through or at least into the wall opening 384, and an inlet end 108 of the ion transfer device 100 faces (and may be disposed in) the first chamber 328 and an outlet end 114 of the ion transfer device 100 faces (and may be disposed in) the second chamber 340. By this configuration, a bore inlet of the ion transfer device 100 as described herein communicates with the first chamber 328, and a bore outlet of the ion transfer device 100 as described herein communicates with the second chamber 340.

According to an embodiment, an ion transfer system as described herein may be provided as part of an interface in a mass spectrometry (MS) system, such as the MS system 300 described above and illustrated in FIG. 3.

Figure 4:
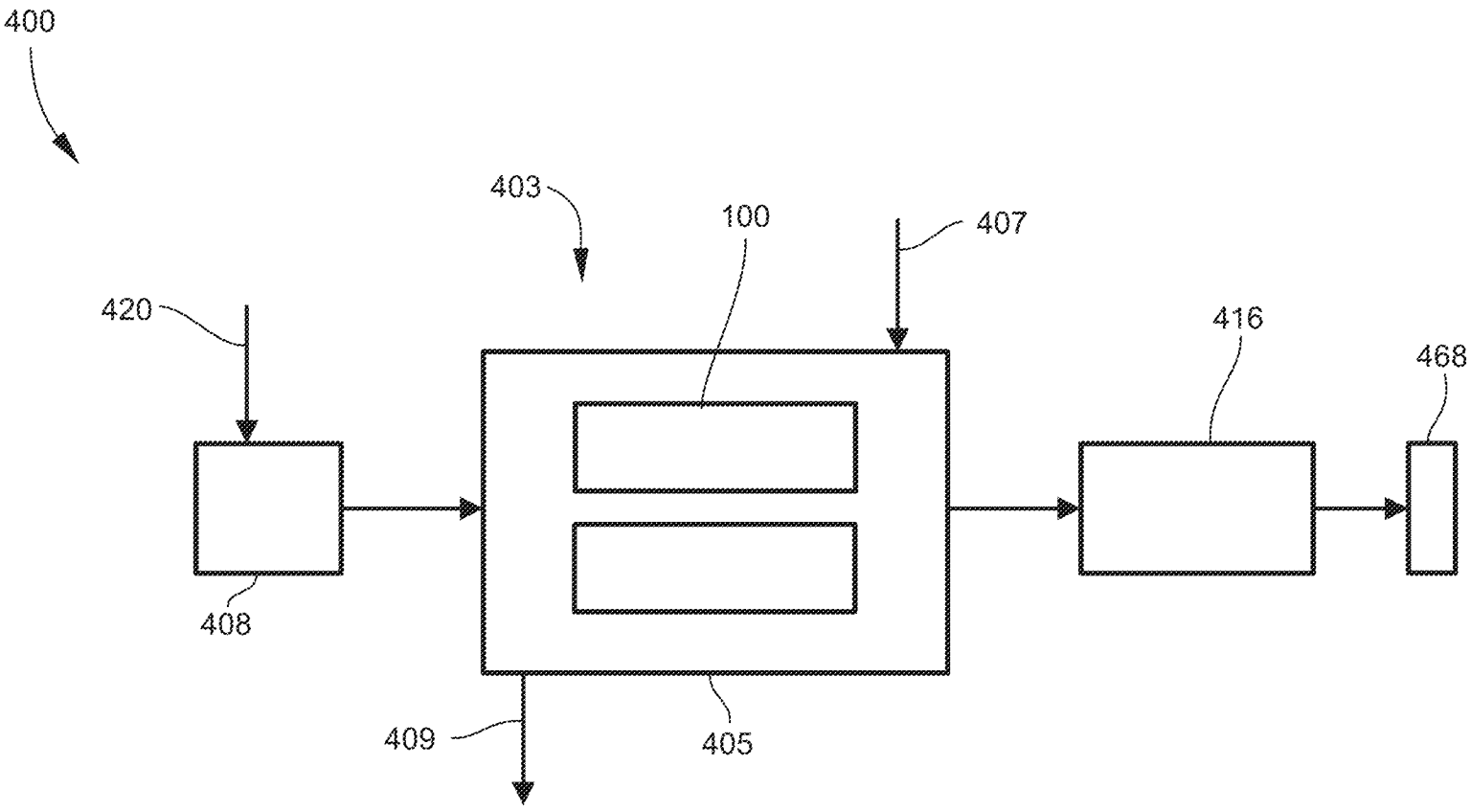
FIG. 4 is a schematic view of an example of an ion mobility spectrometry (IMS) system in which an ion transfer device as presently disclosed herein may be provided according to an embodiment.

FIG. 4 is a schematic view of an example of an ion mobility spectrometry (IMS) system 400 in which an ion transfer device 100 as presently disclosed herein may be provided according to an embodiment. IMS is a gas-phase ion separation technique in which ions produced from a sample in an ion source are separated based on their differing mobilities through a drift cell of known length that is filled with an inert gas of known composition and maintained at a known gas pressure and temperature. In low-electric field drift-type IMS, the ions are urged forward through the drift cell under the influence of a relatively weak, uniform DC potential gradient. The mobility of the ions depends largely on their collision cross-sections (CCSs) and charge states (e.g., +1, +2, or +3), and to a much lesser extent their m/z ratios. Different types of IMS systems, their operating principles, and their components are generally known to persons skilled in the art. Therefore, the example of the IMS system 400 illustrated in FIG. 4 is described herein only briefly to provide a non-limiting context for the presently disclosed ion transfer device 100.

The IMS system 400 includes, in order of ion process flow, an ion source 408 as described herein, an IM drift cell 403, and an ion detector 468 as described herein. The IM drift cell 403 includes a drift cell housing 405, a gas inlet port 407 for introducing an inert drift gas (e.g., argon, nitrogen, etc.) into the drift cell housing 405, and a gas outlet port 409 for exhausting the drift gas from the drift cell housing 405. In the IM drift cell 403, the drift gas is maintained at a controlled drift gas pressure ranging from, for example, 1 to 10 Torr. The IM drift cell 403 further includes a drift tube positioned in the drift cell housing 405. In the present embodiment, the ion transfer device 100 is utilized as the drift tube.

In operation, the ion source 408 produces ions from a sample 420 as described herein. The ions are transmitted into the IM drift cell 403. The electrodes of the ion transfer device 100 are utilized to apply a DC potential gradient along the axial length of the tube of the ion transfer device 100. The ions drift through the conduit of the ion transfer device 100 in the presence of the drift gas while being accelerated by the DC potential gradient, whereby the ions become separated in time based on their different mobilities.

Ions with different mobilities will have different "drift times," i.e. the times taken to traverse the length of the IM drift cell 403. The IM-separated ions exit the IM drift cell 403 and eventually arrive at the ion detector 468. Data acquisition electronics of the IMS system 400 calculate a drift time spectrum (e.g., drift time vs. ion abundance) based on the arrival times of the ions measured by the ion detector 468.

In another embodiment, the IMS system 400 is an IM-MS system. In this case, the IMS system 400 further includes a mass analyzer 416 as described herein. In a typical example, the mass analyzer 416 is positioned downstream from the IM drift cell 403, and thus receives the IM-separated ions. Thus, in such embodiment, both m/z spectra and drift time spectra can be acquired from a sample. Such orthogonal multi-dimensional (IM-MS) data can be useful when analyzing complex samples.

Exemplary Embodiments

Exemplary embodiments provided in accordance with the presently disclosed subject matter include, but are not limited to, the following:

1. An ion transfer device, comprising: a tube comprising an inlet end, an outlet end, a body elongated along a device axis from the inlet end to the outlet end, and an inside surface defining a bore, wherein the bore comprises a bore inlet at the inlet end and a bore outlet at the outlet end, and the bore extends from the bore inlet to the bore outlet along the device axis; a resistive layer disposed on the inside surface and composed of an electrically resistive material; and a dielectric layer disposed on the resistive layer and composed of a dielectric material, wherein the ion transfer device defines a gas conduit in the bore extending from the bore inlet to the bore outlet, and the gas conduit is surrounded by the dielectric layer.

2. The ion transfer device of embodiment 1, wherein the dielectric layer has a thickness in a radial direction orthogonal to the device axis, and the thickness is in a range from 0.005 μm to 300 μm.

3. The ion transfer device of any of the preceding embodiments, wherein the dielectric material is a chemically inert metal oxide.

4. The ion transfer device of any of the preceding embodiments, wherein the dielectric material is selected from the group consisting of silicon dioxide, zirconium dioxide, and hafnium dioxide.

5. The ion transfer device of any of the preceding embodiments, wherein the dielectric layer extends from the bore inlet to the bore outlet.

6. The ion transfer device of any of the preceding embodiments, wherein the gas conduit has a diameter in a range from 0.1 mm to 2 mm.

7. The ion transfer device of any of the preceding embodiments, wherein the electrically resistive material is selected from the group consisting of carbon, cermet, a metal, a conductive polymer, a semiconductor, and hydrogen reduced lead glass, in the form of continuous thin layer or nanoclusters or nanoparticle aggregates.

8. The ion transfer device of any of the preceding embodiments, wherein the tube is composed of an electrically insulating material.

9. The ion transfer device of any of embodiments 1-7, wherein the tube is composed of an electrically resistive material.

10. The ion transfer device of any of the preceding embodiments, comprising an electrical power source communicating with at least one of the tube or the resistive layer, wherein the electrical power source is configured to apply a voltage potential to the tube or the resistive layer.

11. The ion transfer device of any of the preceding embodiments, comprising a heating device to maintain the tube at an elevated temperature.

12. The ion transfer device of any of the preceding embodiments, wherein the tube comprises an outer surface, and the ion transfer device further comprises: an electrically conductive or resistive element disposed on the outer surface; and an electrical power source communicating with the electrically conductive or resistive element, wherein the electrical power source is configured to apply a voltage potential to the electrically conductive or resistive element.

13. An ion transfer system, comprising: the ion transfer device of any of the preceding embodiments; a first chamber; a second chamber configured to be evacuated down to a pressure lower than a pressure of the first chamber; and a wall separating the first chamber and the second chamber and comprising an opening, wherein the ion transfer device extends through the opening such that the bore inlet communicates with the first chamber and the bore outlet communicates with the second chamber.

14. The ion transfer system of embodiment 13, wherein the second chamber comprises a port configured for communication with a vacuum pump.

15. A mass spectrometry (MS) system, comprising: the ion transfer system of embodiment 13; an ionization device configured to produce ions in the first chamber; a vacuum housing enclosing the second chamber; and a mass analyzer disposed in the vacuum housing.

16. The MS system of embodiment 15, wherein the ionization device is an atmospheric-pressure ionization device.

17. An ion mobility spectrometry (IMS) system, comprising: the ion transfer device of any of the preceding embodiments; an ion source; an IM drift cell communicating with the ion source; and an ion detector; wherein the ion transfer device is positioned in the IM drift cell such that the bore inlet is configured to receive ions from the ion source, and the ion detector is configured to receive ions emitted from the bore outlet.

18. The IMS system of embodiment 17, comprising a mass analyzer positioned between the IM drift cell and the ion detector, wherein the mass analyzer is configured to receive ions emitted from the bore outlet and transmit one or more of the ions to the ion detector.

19. A method for transferring ions, the method comprising: drawing ions into the bore inlet of the ion transfer device of any of the preceding embodiments; transporting the ions from the bore inlet, through the gas conduit, and to the bore outlet; and emitting the ions from the bore outlet.

20. The method of embodiment 19, comprising: creating a pressure differential between a first chamber and a second chamber such that the second chamber has a pressure less than a pressure of the first chamber, wherein: the first chamber and the second chamber are separated by a wall; the ion transfer device extends through an opening in the wall from the first chamber to the second chamber; the ions are drawn into the bore inlet from the first chamber; and the ions are emitted from the bore outlet into the second chamber.

21. The method of embodiment 20 comprising transmitting the ions emitted from the bore outlet into a mass analyzer.

22. The method of embodiment 20 or 21, comprising producing the ions in the first chamber.

23. The method of embodiment 19, wherein: the ion transfer device is positioned in an ion mobility (IM) drift cell; transporting the ions is done in the presence of a drift gas in the IM drift cell; and transporting the ions separates the ions in the ion transfer device according to different ion mobilities of the ions.

24. The method of embodiment 23, comprising transmitting the ions emitted from the bore outlet from the drift cell to an ion detector or a mass analyzer.

25. The method of embodiment 23 or 24, comprising transmitting the ions from an ion source into the IM drift cell.

26. The ion transfer device, ion transfer system, MS system, IMS system, or method of any of the preceding embodiments, wherein the dielectric layer is thin enough to allow surface charges to pass through the dielectric layer to the resistive layer, such that the surface charges are subsequently dissipated by the resistive layer.

It will be understood that terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An ion transfer device, comprising:

a tube comprising an inlet end, an outlet end, a body elongated along a device axis from the inlet end to the outlet end, and an inside surface defining a bore, wherein the bore comprises a bore inlet at the inlet end and a bore outlet at the outlet end, and the bore extends from the bore inlet to the bore outlet along the device axis;

a resistive layer disposed on the inside surface and composed of an electrically resistive material; and a dielectric layer disposed on the resistive layer and composed of a dielectric material, wherein the ion transfer device defines a gas conduit in the bore extending from the bore inlet to the bore outlet, and the gas conduit is surrounded by the dielectric layer.

2. The ion transfer device of claim 1, wherein the dielectric layer has a thickness in a radial direction orthogonal to the device axis, and the thickness is in a range from 0.005 μm to 300 μm.

3. The ion transfer device of claim 1, wherein the dielectric material is a chemically inert metal oxide.

4. The ion transfer device of claim 3, wherein the dielectric material is selected from the group consisting of silicon dioxide, zirconium dioxide, and hafnium dioxide.

5. The ion transfer device of claim 1, wherein the dielectric layer extends from the bore inlet to the bore outlet.

6. The ion transfer device of claim 1, wherein the gas conduit has a diameter in a range from 0.1 mm to 2 mm.

7. The ion transfer device of claim 1, wherein the electrically resistive material is selected from the group consisting of carbon, cermet, a metal, a conductive polymer, a semiconductor, and hydrogen reduced lead glass, in the form of continuous thin layer or nanoclusters or nanoparticle aggregates.

8. The ion transfer device of claim 1, wherein the tube is composed of an electrically insulating material.

9. The ion transfer device of claim 1, wherein the tube is composed of an electrically resistive material.

10. The ion transfer device of claim 1, comprising an electrical power source communicating with at least one of the tube or the resistive layer, wherein the electrical power source is configured to apply a voltage potential to the tube or the resistive layer.

11. The ion transfer device of claim 1, comprising a heating device to maintain the tube at an elevated temperature.

12. The ion transfer device of claim 1, wherein the tube comprises an outer surface, and the ion transfer device further comprises:

an electrically conductive or resistive element disposed on the outer surface; and an electrical power source communicating with the electrically conductive or resistive element, wherein the electrical power source is configured to apply a voltage potential to the electrically conductive or resistive element.

13. An ion transfer system, comprising:

the ion transfer device of claim 1;

a first chamber;

a second chamber configured to be evacuated down to a pressure lower than a pressure of the first chamber; and a wall separating the first chamber and the second chamber and comprising an opening, wherein the ion transfer device extends through the opening such that the bore inlet communicates with the first chamber and the bore outlet communicates with the second chamber.

14. The ion transfer system of claim 13, wherein the second chamber comprises a port configured for communication with a vacuum pump.

15. A mass spectrometry (MS) system, comprising:

the ion transfer system of claim 13;

an ionization device configured to produce ions in the first chamber;

a vacuum housing enclosing the second chamber; and a mass analyzer disposed in the vacuum housing.

16. The MS system of claim 15, wherein the ionization device is an atmospheric-pressure ionization device.

17. An ion mobility spectrometry (IMS) system, comprising:

the ion transfer device of claim 1;

an ion source;

an IM drift cell communicating with the ion source; and an ion detector;

wherein the ion transfer device is positioned in the IM drift cell such that the bore inlet is configured to receive ions from the ion source, and the ion detector is configured to receive ions emitted from the bore outlet.

18. The IMS system of claim 17, comprising a mass analyzer positioned between the IM drift cell and the ion detector, wherein the mass analyzer is configured to receive ions emitted from the bore outlet and transmit one or more of the ions to the ion detector.

19. A method for transferring ions, the method comprising:

drawing ions into the bore inlet of the ion transfer device of claim 1;

transporting the ions from the bore inlet, through the gas conduit, and to the bore outlet; and emitting the ions from the bore outlet.

20. The method of claim 19, comprising:

creating a pressure differential between a first chamber and a second chamber such that the second chamber has a pressure less than a pressure of the first chamber, wherein:

the first chamber and the second chamber are separated by a wall;

the ion transfer device extends through an opening in the wall from the first chamber to the second chamber;

the ions are drawn into the bore inlet from the first chamber; and the ions are emitted from the bore outlet into the second chamber.

* * * * *